US009408283B2

(12) United States Patent
Jones et al.

(10) Patent No.: US 9,408,283 B2
(45) Date of Patent: Aug. 2, 2016

(54) ELECTRICAL GROUNDING ARM

(71) Applicants: Michael T. Jones, Walla Walla, WA (US); Christopher A. Woiler, Walla Walla, WA (US); Dean Dunham, Walla Walla, WA (US)

(72) Inventors: Michael T. Jones, Walla Walla, WA (US); Christopher A. Woiler, Walla Walla, WA (US); Dean Dunham, Walla Walla, WA (US)

(73) Assignee: Key Technology, Inc., Walla Walla, WA (US)

( * ) Notice: Subject to any disclaimer, the term of this patent is extended or adjusted under 35 U.S.C. 154(b) by 185 days.

(21) Appl. No.: 14/312,387

(22) Filed: Jun. 23, 2014

(65) Prior Publication Data

US 2015/0373820 A1 Dec. 24, 2015

(51) Int. Cl.
*H05F 3/02* (2006.01)
*H05F 1/00* (2006.01)

(52) U.S. Cl.
CPC ..... *H05F 1/00* (2013.01)

(58) Field of Classification Search
CPC ..... H05F 1/00
See application file for complete search history.

(56) References Cited

U.S. PATENT DOCUMENTS

| | | | | |
|---|---|---|---|---|
| 5,054,605 | A | 10/1991 | Bavis | |
| 6,286,658 | B1 | 9/2001 | Hufford | |
| 6,921,064 | B2 | 7/2005 | Rousseau | |
| 7,136,271 | B2 | 11/2006 | Oh et al. | |
| 8,464,861 | B2 | 6/2013 | Bonn | |
| 8,517,168 | B2 | 8/2013 | Hufford | |
| 2013/0329333 | A1 * | 12/2013 | Minteer | B64D 45/02 361/218 |
| 2014/0097065 | A1 | 4/2014 | Woiler et al. | |

OTHER PUBLICATIONS

PCT Search Report dated Aug. 12, 2015.

* cited by examiner

*Primary Examiner* — Thienvu Tran
*Assistant Examiner* — Tien Mai
(74) *Attorney, Agent, or Firm* — Randall Danskin

(57) ABSTRACT

An electrical grounding arm is described and which has a predetermined geometry that dissipates stress imparted to the electrical grounding arm by the repeated movement of the electrical grounding arm, so as to inhibit stress related damage from being imparted to the electrical grounding arm, and which further, inhibits a source of fluid from pooling or collecting on the exterior facing surface thereof in order to prevent an unsanitary condition from developing.

8 Claims, 5 Drawing Sheets

ELECTRICAL GROUNDING ARM

TECHNICAL FIELD

The present invention relates to an electrical grounding arm, and more specifically to an electrical grounding arm which is designed to connect the base frame, and a vibratory conveyor bed in such a manner so as to eliminate static electrical charge buildup in an appropriate manner.

BACKGROUND OF THE INVENTION

Vibratory conveyors have been used for decades in various industrial applications. As a general matter, vibratory conveyors include a base frame, and a vibratory conveyor bed which is mounted in spaced relation relative to the base frame, and which further reciprocates in a given pattern in order to move a product, or objects of interest along a given course of travel for further processing.

Depending upon the product being transported, and the environment in which the vibratory conveyor is used, static electricity may build up in either the base frame, or the vibratory conveyor, and which must be dissipated in order to avoid an accidental discharge of the static electricity. It is well known that these electrical discharges of static electricity may cause damage to the vibratory conveyor; electrical devices in the area of the vibratory conveyor, or potentially can ignite combustible materials in the region of the electrical discharge.

To electrically couple the movable vibratory conveyor bed with the underlying base frame so as to provide an electrical pathway for discharging a static electricity charge, various methodologies have been used in the past. For example, this electrical coupling has, heretofore, been achieved by a stainless steel braided cable which had crimped end connections which allowed the stainless steel cable or strap to be secured to the vibratory conveyor, and to the underlying base frame. In this regard this stainless steel braided cable typically was electrically connected by way of the fasteners which had been employed to secure a plurality of supporting, flexible leaf springs to the base frame, and conveyor bed. These flexible leaf springs supported the movement of the vibratory conveyor in spaced relation relative to the base frame.

While this solution worked with some degree of success, the attachment of the metal braided cable in this fashion created a continuous bending at a given location in the cable. This subsequent and repeated bending led to a failure of the cable near the crimped connection which had been formed. Therefore, periodic maintenance was required to replace these braided cables to prevent an accidental discharge of accumulated static electricity.

Other designs have been implemented to try and mitigate the failure which was attendant to the repeated movement of the cable by the reciprocal motion of the conveyor bed. One possible solution was to provide, a rolling-flex braided cable. However, the problem associated with using a rolling-flex cable to mitigate a bending failure was that such a rolling-flex cable required a rather large radius to achieve any measurable benefit. This large radius interfered with other assemblies mounted on the vibratory conveyor and therefore only provided minimal benefit.

In another attempt to try and solve the underlying problem discussed above, sheet metal straps were used, and which were fabricated in a manner so as to allow the stainless steel straps to be secured in the same manner as the earlier employed steel braided cable, to the leaf springs which support the vibratory conveyor bed. Again, this metal strap was still subjected to the same vibratory force experienced by the conveyor bed, and consequently a bending failure occurred in the stainless steel strap at the point where the metal strap was secured by fasteners to the conveyor bed. Further, a rolling configuration made from a strap of stainless steel was attempted. In this rolling-flex configuration the problems associated with the cable remained, that being, that the rather large radius required to achieve measurable benefit, and the subsequent interference with the adjacent spring assemblies used to support the conveyor bed achieved little or no measurable benefit. It was discovered that compromises made to the radiuses which were employed, resulted in premature failures that had only a slightly longer lifetime as compared to that experienced with the bending failure mode as seen with the earlier employed stainless steel braided cables.

In view of these problems, manufacturers of vibratory conveyors have continued to seek an effective means whereby a movable object, such as a vibratory conveyor, can be effectively, electrically coupled to an underlying base frame in a manner which provides effective dissipation of accumulated static electricity in a manner which avoids the shortcomings attendant with the prior art practices that were utilized heretofore. An electrical grounding arm is the subject matter of the present invention.

SUMMARY OF THE INVENTION

A first aspect of the present invention relates to an electrical grounding arm which includes an elongated, electrically conductive main body having opposite first and second ends, and which are respectively electrically coupled to a first and second spaced object which cooperate, together, and wherein at least one of the first or second spaced objects moves relative to the other object, and wherein the main body of the electrical grounding arm has a predetermined geometry, and wherein the motion of one of the first of second objects imparts motion to the electrical grounding arm which is electrically coupled with each of the first and second spaced objects, and wherein the motion of the electrical grounding arm imparts stress to the main body thereof, and wherein the geometry of the main body of the electrical grounding arm dissipates the stress imparted to the main body so as to inhibit stress related damage from being imparted to the electrical grounding arm.

Still another aspect of the present invention relates to a grounding arm which includes an electrically conductive main body having opposite first and second ends, and which are respectively electrically coupled to a first and a second spaced object, and wherein at least one of the first or second, spaced objects, reciprocally moves relative to the other object, and wherein the main body has an intermediate portion which is located between the first and second ends, and which further has a peripheral edge, and wherein the main body of the electrical grounding arm has a width dimension which diminishes when measured from the opposite first and second ends, and in the direction of the intermediate portion of the main body.

These and other aspects of the present invention will be discussed in greater detail hereinafter.

BRIEF DESCRIPTION OF THE DRAWINGS

Preferred embodiment of the present invention is described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts." (Article I, Section 8).

Figure 1:
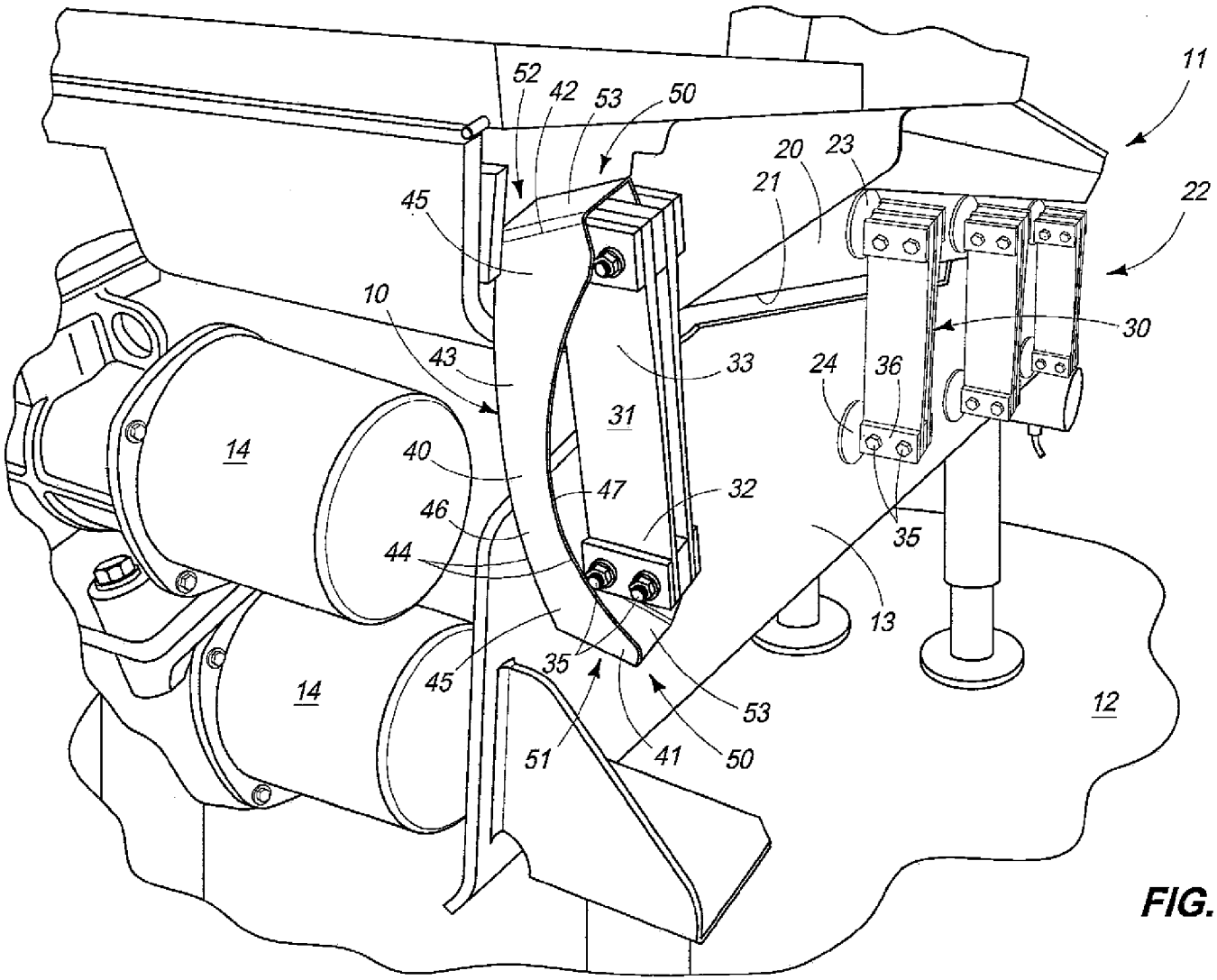
FIG. 1 is a perspective, fragmentary, side elevation view of the electrical grounding arm of the present invention and which is shown in a typical operational environmental where it is installed on a vibratory conveyor of traditional design.

Referring now to FIG. 1 a vibratory conveyor 11 of traditional design is illustrated. The vibratory conveyor is positioned in spaced relation relative to an underlying supporting surface 12. The vibratory conveyor includes an elongated base frame 13 which is mounted in spaced relation relative to the supporting surface 12. The base frame 13 further mounts a drive assembly 14 of traditional design. The drive assembly, when energized, imparts energy or force into the base frame 13, and which is subsequently transmitted to a reciprocally movable conveyor bed which is disposed in spaced relation relative thereto. The conveyor bed will be discussed in detail, below.

Figure 2:
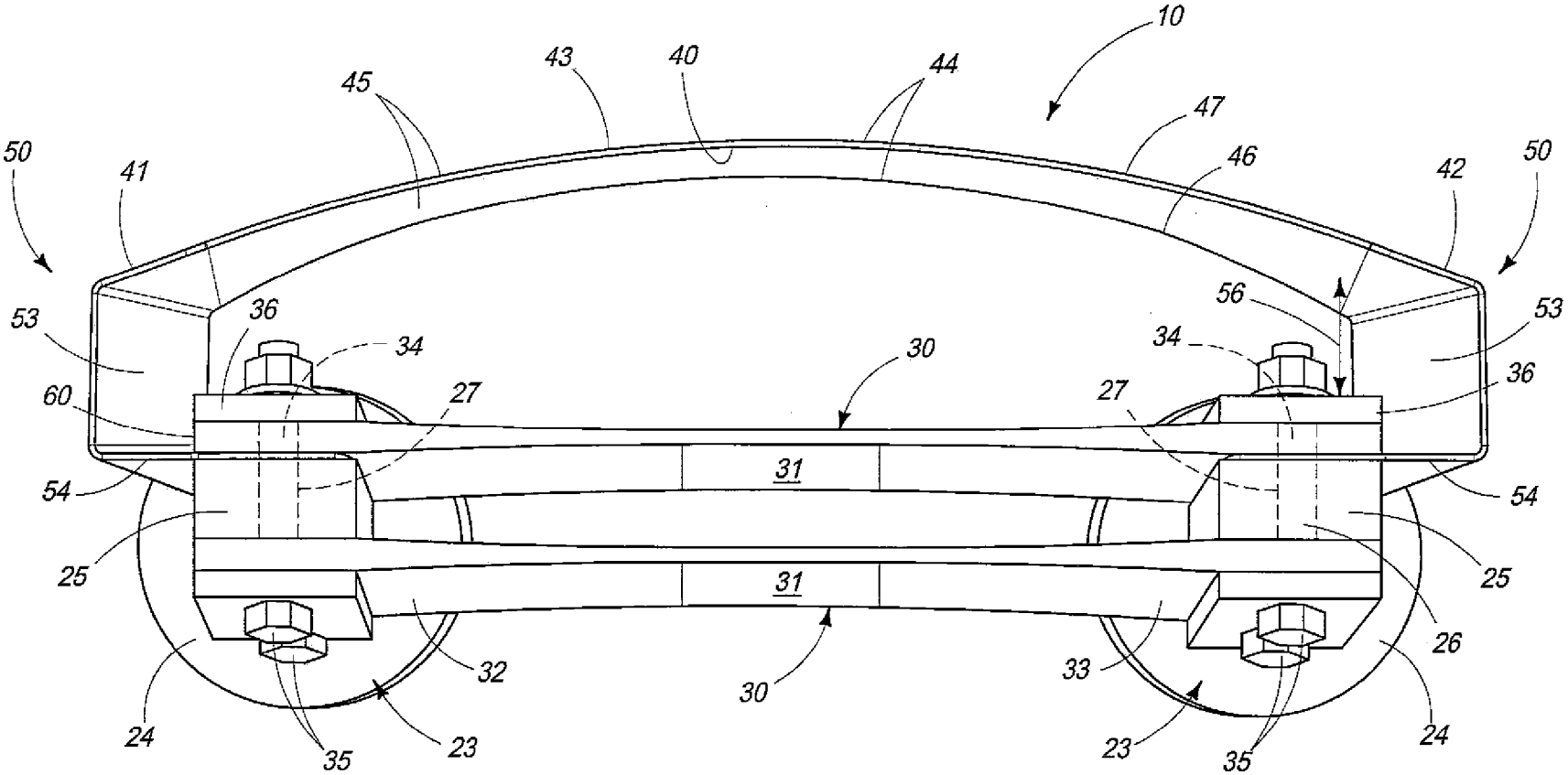
FIG. 2 is a first, side elevation view of the electrical grounding arm of the present invention.

The vibratory conveyor 11, as discussed, above, includes a reciprocally movable conveyor bed, which is generally indicated by the numeral 20. The conveyor bed 20, has a bottom surface 21, and which is positioned in spaced relation relative to the base frame 13. For purposes of the present application the base frame, and conveyor bed, 13 and 20, respectively, constitute first and second, spaced objects which cooperate together, and wherein at least one of the first or second spaced objects moves, one relative to the other. As will be appreciated from the drawings, and which is well known in the art, the drive assembly 14 imparts energy or force into the base frame which is subsequently transmitted to the conveyor bed 20, so as to facilitate a reciprocal motion of the conveyor bed 20 relative to the base frame 13. This reciprocal motion is caused, at least in part, by the effect of a multiplicity of leaf spring assembles which are generally indicated by the numeral 22, and which couple the conveyor bed 20 to the base frame 13. The respective leaf spring assemblies will be discussed in the paragraphs below. As will be seen from a study of FIG. 1, the electrical grounding arm 10 as seen in FIG. 1, and following, provides an electrical pathway between the conveyor bed 20, and the frame 13, so as to allow an effective dissipation of any static electrical build-up which might occur between these two objects. As best seen in the drawings as provided, and which further is well known in the art, individual mounting fixtures 23 are respectfully attached to each of the base frame 13, and conveyor bed 20. The respective mounting fixtures 23, have a base plate 24, and which is affixed, as by welding or the like, to the respective base frame 13, or conveyor bed 20. The base plate 24, therefore, provides an electrical connection to these respective assemblies. Still further, and mounted on the base plate 24, and extending laterally outwardly relative thereto is a post 25 which is also formed of an electrically conductive material. The outwardly extending post has opposite sides 26. Further, fastener apertures, which are generally indicated by the numeral 27, pass or extend through the outwardly extending post 25. This is seen in FIG. 2.

As seen in the drawings, the vibratory conveyor 11 utilizes individual leaf springs 30 of traditional design, and which moveably support the conveyor bed 20 in spaced relation to the base frame 13. The respective leaf springs are well known, and have a main body 31 with opposite first and second ends 32 and 33 respectively. As seen in FIG. 1, the respective leaf springs 31 extend upwardly from the base frame 13 to support the conveyor bed 20 in spaced relation relative thereto. As seen in FIG. 2, fastener apertures 34 are formed in the opposite first and second ends 32 and 33 respectively. Further threaded fasteners 35 are provided, and which pass through the coaxially aligned apertures 27 and 34, respectively, so as to secure the first and second ends 32 and 33, of the main body 31, to the respective opposite sides 26, of the outwardly extending post 25. A clamping plate 36, of traditional design, is provided, and which is operable to sandwich the respective first and second ends 32 and 33 of the individual leaf springs between the clamping plate 36, and the opposite sides 26 of the outwardly extending post 25. This fastening technique is well known in the art.

Figure 4:
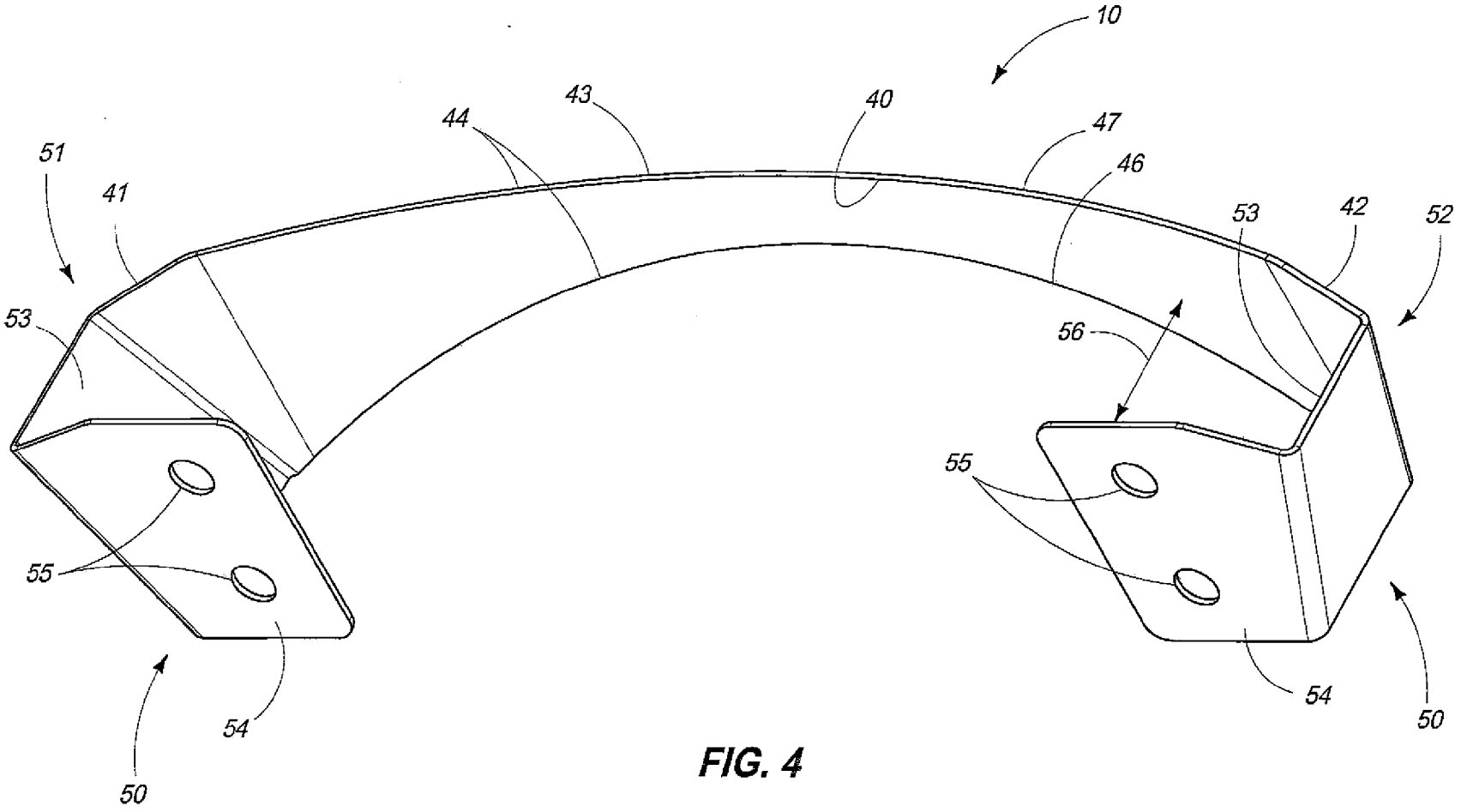
FIG. 4 is a perspective, side elevation view of the electrical grounding arm.
Figure 5:
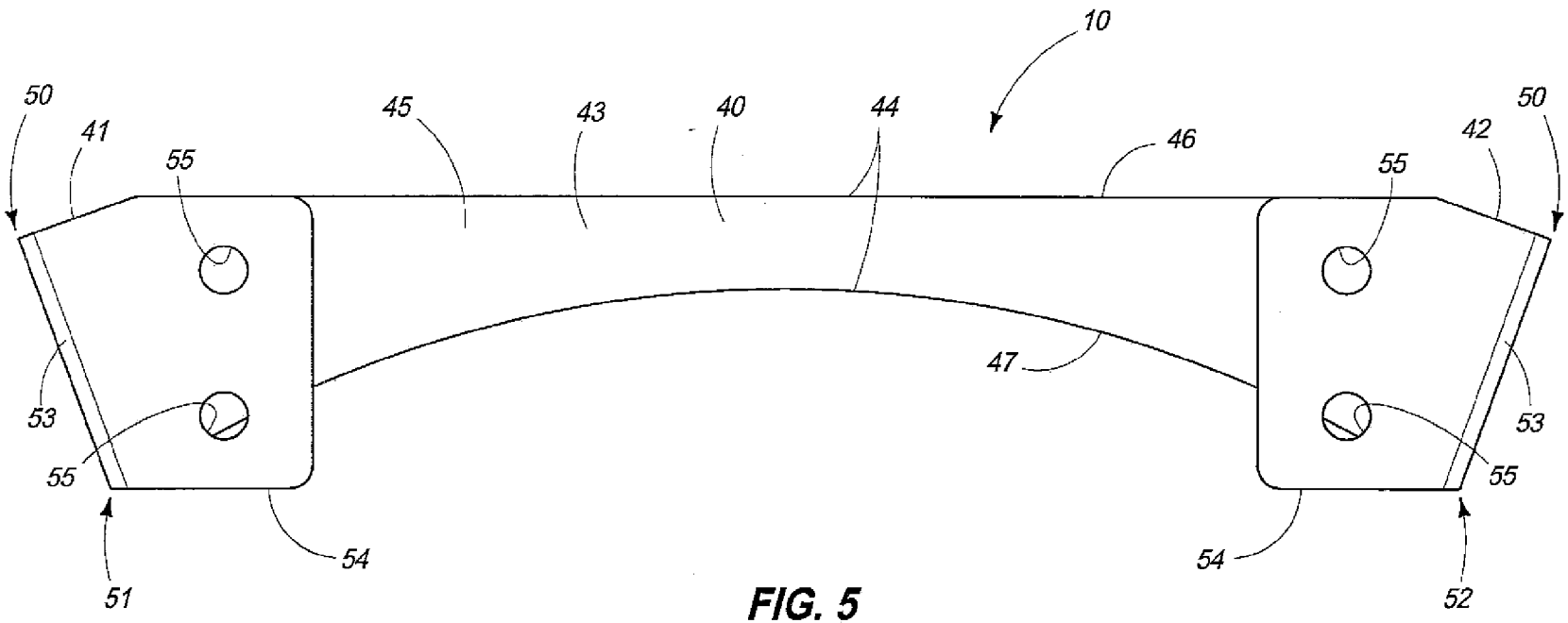
FIG. 5 is a second, side elevation view of the electrical grounding arm of the present invention.

The electrical grounding arm 10 as seen in FIG. 1, and following, includes an elongated main body which is generally indicated by the numeral 40. The elongated main body is electrically conductive, and further has a first end 41, and an opposite second end 42. The main body has a length dimension, as measured between the opposite first and second ends 41 and 42, and which is greater than a length dimension of the respective individual leaf springs 30, as previously described. Still further, the main body 40 has a width dimension which is variable, but which is typically not greater than the width dimension of the multiplicity of leaf springs 30 as earlier described. The main body 40 further has an intermediate portion 43, and which is located between the first and second ends 41 and 42. As seen in the drawings, the main body 40 has a width dimension which, on the one hand, diminishes when measured in a direction extending from the first and second ends respectively 41 and 42, and toward the intermediate portion 43; or, on the other hand, increases when measured from the intermediate portion 43, and in the direction of the first and second ends 41 and 42, respectively. As illustrated in the drawings, the main body 40 has spaced, generally longitudinally extending peripheral edges 44, and which extend between the opposite first and second ends 41 and 42. Still further, the main body 40 has an exterior facing surface 45. As will be recognized from the drawings, the electrical grounding arm 10 has an exterior facing surface 45 which has a unique geometry such that no portion of the exterior facing surface of the electrical grounding arm has a region upon which a source of a fluid may pool, or collect, so as to create an unsanitary condition as may be the case when a vibratory conveyor of the current design 11 is employed in food processing applications. As can be seen by reference to FIGS. 2 and 4, the main body 40 has a geometry which includes a curvature in the main body 40, and which extends longitudinally relative thereto, and between the first and second ends 41 and 42 respectively. As illustrated in the drawings (FIG. 5), the longitudinally extending peripheral edges 44 include a first peripheral edge 46, which is substantially straight along a preponderance of its length; and a second peripheral edge 47, and which is spaced therefrom, and which has a predetermined curvature as seen in FIGS. 2 and 5. The geometry of the main body 40 provides other benefits as will be discussed in greater detail, below.

The main body 40 of the electrical grounding arm 10 includes a pair of laterally extending arms that are generally indicated by the numeral 50, and which are individually mounted to, or made integral with, the first and second ends 41 and 42, thereof. The pair of laterally extending arms 50 include a first arm 51, which extends laterally outwardly from the first end 41; and a second arm 52 which extends laterally outwardly relative to the second end 42 of the main body 40. Each of the first and second arms 51 and 52 are formed of a first portion 53 which is made integral with, and extends outwardly relative to the opposite first and second ends 41 and 42 respectively. Still further the respective first and second arms 51 and 52 has a second portion 54, and which is made integral with the first portion 53, and which is positioned substantially perpendicular relative thereto. The second portion 54 has a given angular geometry relative to the first portion, and it further has a pair of fastening apertures 55 which are formed therethrough. Still further, a predetermined gap 56 is defined between the second portion 54, and the respective first and second ends 41 and 42 respectively. As will be appreciated from the drawings, the second portion 54 is sandwiched, or otherwise clamped between the respective ends 32 and 33 of one of the leaf springs 30 as illustrated in the drawings, and one of the opposite sides 26, of the outwardly extending post 25, and which are made integral with a mounting fixture 23. The fastening apertures 55 are formed in a fashion so that they individually coaxially align with, and can receive therethrough the individual fasteners 34 which extend through the outwardly extending post 25. Again, the leaf springs, and the second portion 55 are held in place by the clamping plate 36. As will be recognized in this arrangement, the elongated main body 40 of the grounding arm 10 is clamped into a secure, electrically conductive relationship relative to the outwardly extending post 25 thereby securably electrically coupling the main body 40 in an orientation so as to effectively conduct electrical current between the vibratory conveyor bed 20, and the underlying and spaced base frame 13.

Figure 3:
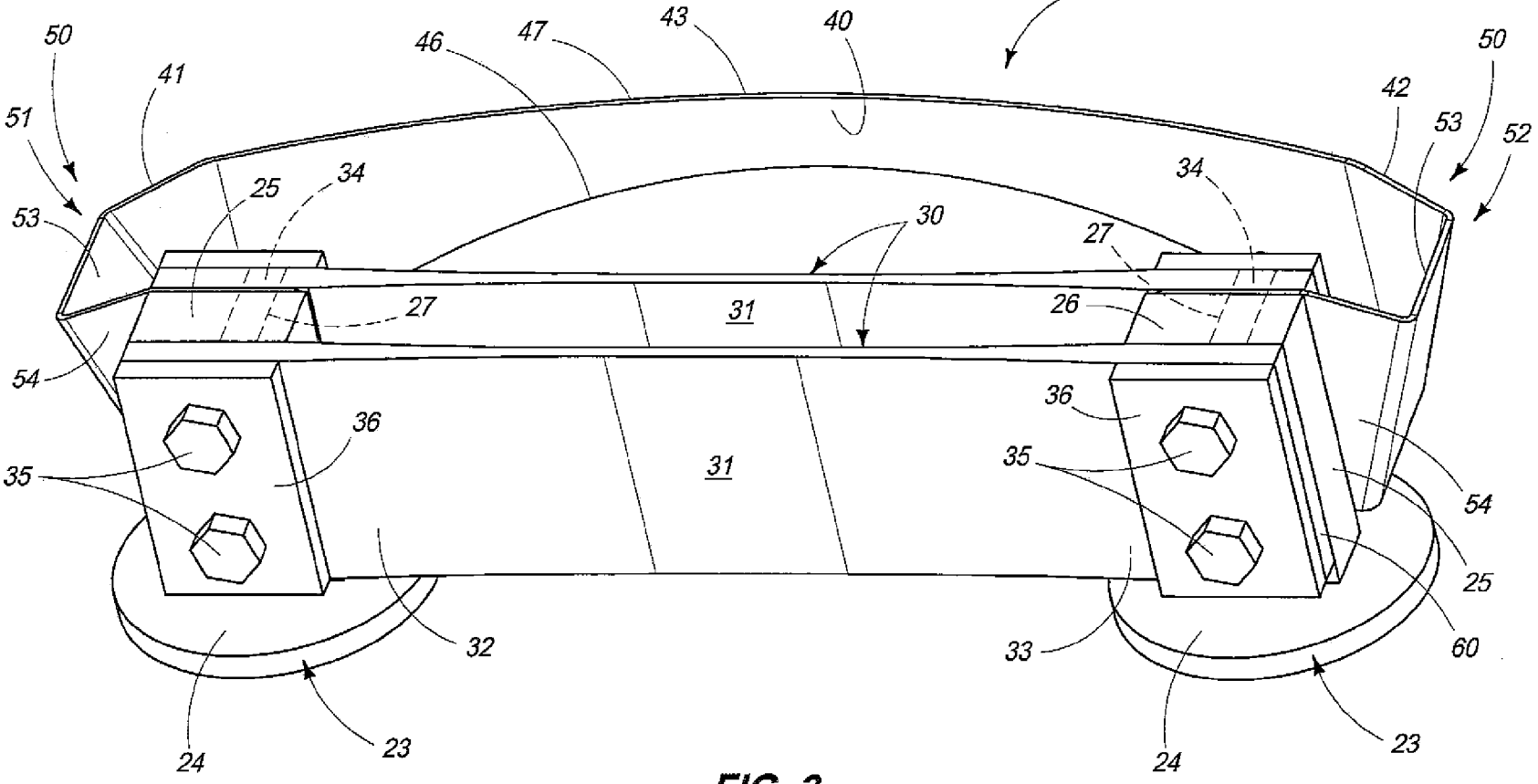
FIG. 3 is a second, side elevation view taken from a position which is 90 degrees, offset, from that seen in FIG. 2.

As seen in the drawings, the present electrical grounding arm 10 has a unique geometry which provides an effective means for the electrical grounding arm 10 to dissipate stress which is imparted to the main body 40 by the reciprocal motion of the conveyor bed 20. The motion of the conveyor bed 20, of course, causes a corresponding motion to the individual leaf springs 30, and which support the conveyor bed 20 in spaced relation relative to the base frame 13. In view of the nature of the movement of the respect leaf springs 30 as illustrated, the bending stress imparted by the movement to the main body 40 is dissipated by the geometry of the main body 40 so as to inhibit any stress related damage from being imparted to the electrical grounding arm 10. In this regard, the unique geometry features of the main body 40 include that it is curved. This is seen in FIG. 2. Still further, the unique width dimensions of the main body, that is, that the width of the main body 40 diminishes when measured from the opposite first and second ends 41 and 42 towards the intermediate portion 43 (FIG. 5) is effective, to so some degree, to dissipate the stress imparted to the main body 40 by the reciprocal motion of the conveyor bed 20. Still further and as illustrated, (FIG. 1), it will be seen that the peripheral edges, 60, of the first and second ends of the respective leaf springs 32 and 33 are generally perpendicular relative to the longitudinal axis of the respective springs. However, as will be recognized, (FIG. 3), the first portion 53 of the respective pair of laterally extending arms 50 is oriented in an angularly outwardly extending orientation relative to ends of the respective leaf springs 30. Additionally, the second portion 54 is oriented in substantially parallel, juxtaposed relation relative to the first and second ends 32 and 33 of the respective leaf springs 30. It has been discovered that the geometry, as illustrated, and described herein, is effective in dissipating the bending stress imparted by the reciprocal motion of the conveyor bed 20 to the main body 40 thereby enhancing the longevity of the grounding arm's operational lifetime, and preventing the grounding arm from breaking electrical contact between the conveyor bed 20 and the base frame 13.

OPERATION

The operation of the described embodiment of the present invention is believed to be readily apparent, and is briefly summarized at this point.

Referring now to the drawings, it will be seen that the present invention includes, or is directed to, an electrical grounding arm 10 which has an elongated, electrically conductive main body 40. The main body 40 has opposite first and second ends 41 and 42, and which are respectively electrically coupled to a first and second spaced object, here indicated by the numerals 13 and 20, respectively, and which movably cooperate, together. Still further, in the arrangement, as illustrated, the main body 40 of the electrical grounding arm 10, has a predetermined geometry, and wherein the motion of one of the first or second objects 13 and 20, respectively, imparts motion to the electrical grounding arm 10. The motion of the electrical grounding arm 10 imparts stress to the main body 40 thereof. The geometry of the main body 40 of the electrical grounding arm 10 dissipates the stress imparted to the main body 40 so as to inhibit stress related damage from being imparted to the electrical grounding arm 10. As earlier disclosed, past attempts to electrically couple two moving objects together has resulted in failure of the electrical coupling due to the bending forces imparted on the electrical pathway coupling the two objects together.

In the present invention, the main body 40 of the electrical grounding arm 10 has an exterior facing surface 45. The geometry of the main body 40 of the electrical grounding arm 10 has no exterior facing surfaces 45 upon which a source of a fluid may pool or collect so as to create an unsanitary condition. This feature is particularly important when a vibratory conveyor 11, such as illustrated in FIG. 1 is employed in food processing applications.

As seen in the drawings, the main body 40 of the electrical grounding arm 10 has an intermediate portion 43, and which is located between the first and second ends 41 and 42 thereof. Further, the main body 40 has opposite, longitudinally oriented peripheral edges 44. The main body 40 has a width dimension which increases when measured in a direction extending from the intermediate portion 43 of the main body 40 and in the direction of the first and second ends 41 and 42 thereof. As seen in the drawings, at least one of the opposite, longitudinally oriented peripheral edges 44 of the main body 40, has a predetermined curvature which is generally indicated by the numeral 47.

The main body 40 of the electrical grounding arm 10 has a pair of laterally extending arms 50, and which are individually mounted to the first and second ends 41 and 42 thereof. The respective laterally extending arms have a first portion 53 which is made integral with the main body 40, and a second portion 54 which is made integral with the first portion 53. The first and second portions 53 and 54 are oriented in a perpendicular relationship, one relative to the other. In the arrangement as seen in the drawings, the first object comprises a base frame 13 for a vibratory conveyor 11, and the second object comprises a reciprocally movable conveyor bed 20, and which is held in spaced relation relative to the base frame 13 by a multiplicity of leaf springs 30, and which extend in a given direction outwardly from the base frame 30, and which further support the conveyor bed 20 for movement relative to the base frame 13. The respective leaf springs 30 are mounted to each of the base frame 13, and conveyor bed 20 by electrically conductive mounting fixtures 23. The second portion 54 of the laterally extending arms 50 are located between at least one of the leaf springs 30, and one of the underlying mounting fixtures 23, and which is located on, and electrically coupled to either the base frame 13, or the conveyor bed 20. In this arrangement, the electrical grounding arm 10 is electrically coupled, as by clamping, to the base frame 30, and the conveyor bed 20. The geometry of the electrical grounding arm 10 is such that the intermediate portion 43 of the main body 40 is located in predetermined spaced relation relative to the underlying leaf springs 30.

Therefore, it will be seen that the present invention 10 provides a convenient means whereby spaced objects, here shown as a base frame 13, and a conveyor bed 20, and which is reciprocally movable relative thereto, may be electrically coupled together in a predetermined way so as to provide a dissipation of a static electrical charge in a manner not possible heretofore. The present invention is robust; resists bending and other stress related damage which might be imparted to same by the continued reciprocal movement of the conveyor bed; and further, has a geometry which is easy to clean and prevents the accumulation of liquids and other materials which might pool or collect on the exterior facing surface 45 so as to create an unsanitary and unsafe environment.

In compliance with the statute, the invention has been described in language more or less specific as to structural and methodical features. It is to be understood, however, that the invention is not limited to the specific feature shown and described since the means herein disclosed comprise preferred forms of putting the invention into effect. The invention is, therefore, claimed in any of its forms or modifications within the proper scope of the appended claims appropriately interpreted in accordance with the doctrine of equivalence.

We claim:

1. An electrical grounding arm, comprising:

an elongated, electrically conductive main body having opposite first and second ends, and which are respectively electrically coupled to a first and second spaced object which cooperate, together, and wherein at least one of the first or second spaced objects moves relative to the other object, and wherein the first object comprises a base frame for a vibratory conveyor, and the second object comprises a reciprocally movable conveyor bed and which is held in spaced relation relative to the base frame by a multiplicity of leaf springs which extend in a given direction outwardly relative to the base frame, and which support the conveyor bed for movement relative to the base frame, and wherein the multiplicity of leaf springs are mounted to each of the base frame, and conveyor bed by electrically conductive mounting fixtures, and wherein the main body of the electrical grounding arm has a predetermined geometry, and the main body of the electrical grounding arm has an exterior facing surface, and the geometry of the main body of the electrical grounding arm has no exterior facing surface upon which a source of fluid may pool, or collect so as to create an unsanitary condition, and wherein the main body of the electrical ground arm has an intermediate portion which is located between the first and second ends, and opposite, longitudinally oriented peripheral edges, and wherein the main body has a width dimension, and wherein the width dimension of the main body increases when measured in a direction extending from the intermediate portion of the main body, and in the direction of the first and second ends thereof, and wherein at least one of the opposite, longitudinally oriented peripheral edges of the main body has a predetermined curvature, and the main body has laterally extending arms which are individually mounted to the first and second ends thereof, and which have a first portion which is made integral with the main body, and a second portion, which is made integral with the first portion, and wherein the first and second portions are oriented in a perpendicular relationship, one relative to the other, and wherein the second portion of the laterally extending arms are located between at least one of the leaf springs, and one of the underlying mounting fixtures which is located on, and electrically coupled to, the base frame, and conveyor bed, so as to electrically couple the base frame and conveyor bed together, and wherein the motion of one of the first or second objects imparts motion to the electrical grounding arm which is electrically coupled with each of the first and second spaced objects, and wherein the motion of the electrical grounding arm imparts a stress to the main body thereof, and wherein the geometry of the main body of the electrical grounding arm dissipates the stress imparted to the main body so as to inhibit any stress related damage from being imparted to the electrical grounding arm.

2. An electrical grounding arm as claimed in claim 1, and wherein the laterally extending arms of the electrical grounding arm positions the intermediate portion of the main body in predetermined spaced relation relative to the leaf springs.

3. An electrical grounding arm, comprising:

an electrically conductive main body having opposite first and second ends, and which are respectively electrically coupled to a first and a second spaced object, and wherein at least one of the first or second, spaced objects, reciprocally moves relative to the other object, and wherein the first object comprises a base frame for a vibratory conveyor, and the second object comprises a reciprocally movable conveyor bed and which is held in spaced relation relative to the base frame by a multiplicity of leaf springs which extend upwardly relative to the base frame, and which support the conveyor bed for movement relative to the base frame, and wherein the multiplicity of leaf springs are mounted to each of the base frame, and conveyor bed by electrically conductive mounting fixtures, and wherein the first and second ends of the main body of the electrical grounding arm are respectively, electrically coupled to the individual mounting fixtures located on the base frame, and conveyor bed, and wherein the main body has an intermediate portion which is located between the first and second ends, and further has a peripheral edge, and wherein the main body of the electrical grounding arm has a width dimension which diminishes when measured from the opposite first and second ends, and in the direction of the intermediate portion of the main body, and wherein the main body has a centrally disposed and curved portion, and individual, distally located, and laterally extending arms, and which are located at the opposite first and second ends of the main body, and wherein the respective laterally extending arms have a first portion which is made integral with the curved portion of the main body, and a second portion which is electrically coupled to one of the first or second spaced objects, and wherein the first and second portions of the laterally extending arms are perpendicular, one relative to the other.

4. An electrical grounding arm as claimed in claim 3, and wherein the respective leaf springs each have a predetermined length dimension, and the electrical grounding arm has a length dimension greater than the length dimension of the respective leaf springs.

5. An electrical grounding arm as claimed in claim 4, and wherein the respective leaf springs each have a predetermined and uniform width dimension, and wherein the maximum width dimension of the main body of the electrical grounding arm is equal to the width dimension of the respective leaf springs.

6. An electrical grounding arm as claimed in claim 5, and wherein each mounting fixture has an outwardly extending post having opposite sides, and wherein the individual leaf springs are each mounted on the opposite sides of the outwardly extending post, and wherein the second portion of each of the laterally extending arms is sandwiched therebetween at least one the leaf springs, and the underlying outwardly extending post of the mounting fixture to which the overlying leaf spring is attached so as to make an electrical connection between the electrical grounding arm, and the mounting fixture.

7. An electrical grounding arm as claimed in claim 6, and wherein the reciprocal motion of the conveyor bed imparts motion to each of the leaf springs, and the electrical grounding arm which is electrically coupled with the mounting fixture, and wherein the motion of the electrical grounding arm imparts stress to the main body thereof, and wherein an overall geometry of the main body of the electrical grounding arm dissipates the stress imparted to the main body so as to inhibit stress related damage from being imparted to the electrical grounding arm.

8. An electrical grounding arm as claimed in claim 7, and wherein the main body of the electrical grounding arm has an exterior facing surface, and the geometry of the main body of the electrical grounding arm has no exterior facing surface upon which a source of fluid may pool, or collect so as to create an unsanitary condition.

* * * * *